US008578903B2

(12) United States Patent
Merelle et al.

(10) Patent No.: US 8,578,903 B2
(45) Date of Patent: Nov. 12, 2013

(54) GLOW PLUG FOR USE IN AN INTERNAL COMBUSTION ENGINE

(75) Inventors: Marie Merelle, Fellbach (DE); Albrecht Geissinger, Muehlacker (DE); Pavlo Saltikov, Waiblingen (DE); Susanne Liemersdorf, Sachsenheim (DE); Andreas Reissner, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 604 days.

(21) Appl. No.: 12/804,743

(22) Filed: Jul. 27, 2010

(65) Prior Publication Data

US 2011/0048356 A1 Mar. 3, 2011

(30) Foreign Application Priority Data

Aug. 27, 2009 (DE) ..... 10 2009 028 948

(51) Int. Cl.
*F23Q 7/00* (2006.01)

(52) U.S. Cl.
USPC ..... 123/145 A

(58) Field of Classification Search
USPC ..... 123/145 R, 145 A, 143 B
See application file for complete search history.

(56) References Cited

U.S. PATENT DOCUMENTS

| | | | | |
|---|---|---|---|---|
| 4,725,711 | A * | 2/1988 | Minegishi et al. | 219/270 |
| 4,806,734 | A * | 2/1989 | Masaka et al. | 219/270 |
| 5,059,768 | A * | 10/1991 | Hatanaka et al. | 219/270 |
| 5,218,183 | A * | 6/1993 | Kimata | 219/270 |
| 5,945,019 | A * | 8/1999 | Tanaka et al. | 219/541 |
| 6,437,492 | B1 * | 8/2002 | Geissinger et al. | 313/118 |
| 6,759,631 | B1 | 7/2004 | Geissinger et al. | |

FOREIGN PATENT DOCUMENTS

| | | |
|---|---|---|
| DE | 103 06 299 | 9/2003 |
| EP | 1 768 456 | 3/2007 |

* cited by examiner

*Primary Examiner* — Hai Huynh
(74) *Attorney, Agent, or Firm* — Kenyon & Kenyon LLP

(57) ABSTRACT

A glow plug, in particular for use in an internal combustion engine. The glow plug includes at least one heating body and at least one housing. The heating body has at least one first terminal contact extending from a base body of the heating body into a housing. The glow plug also has a second terminal contact extending at least partially within the housing. At least one contacting element having at least one opening is provided inside the housing, the first terminal contact and the second terminal contact being introduced into the opening from opposite sides and being electrically connected.

15 Claims, 2 Drawing Sheets

GLOW PLUG FOR USE IN AN INTERNAL COMBUSTION ENGINE

BACKGROUND OF THE INVENTION

1. Field of the Invention

The present invention is based on known glow plugs and methods for manufacturing such glow plugs.

2. Description of Related Art

Glow plugs, in particular sheathed-element glow plugs, are suitable in particular for use in internal combustion engines, for example, for use for cold start of diesel engines or other engines, in particular spontaneous ignition internal combustion engines. Glow plugs may also be used in other areas of combustion technology.

A known example of glow plugs and in particular sheathed-element glow plugs is described in published European patent application EP 1 768 456 A1, where a ceramic heating body is used as the sheathed element, heating wires and a heating resistor being situated inside thereof. One of the heating wires is contacted from the circumferential side of the heating body. The other heating wire is led axially out of the glow pencil-shaped heating body as a terminal contact via an extension.

However, one problem with known glow plugs, in particular sheathed-element glow plugs made of silicon nitride ($Si_3N_4$), involves electrical contacting of the terminal contacts. For example, glow plugs made of silicon nitride are often contacted via a comparatively sensitive metal "cap connection" by which the terminal contact in the form of a wire, for example, is held on the ceramic. The wire is led into a housing of the glow plug, where it is connected to a terminal pin, e.g., by screwing, spot welding, crimping or similar joining techniques. Next the housing is filled with a ceramic powder filling, and the fixation between the wire and the terminal pin is reinforced by hammering the housing.

However, there are a number of technical challenges for this manufacturing operation in practice. First, the filling of the housing with the ceramic powder, followed by the hammering operation, is comparatively complex. Another problem is that the sensitive heating bodies, for example ceramic heating bodies, may be damaged in the hammering operation.

SUMMARY OF THE INVENTION

It is an object of the invention to provide a glow plug and a method for manufacturing a glow plug which at least partially solve the problems of known glow plugs and manufacturing methods. The glow plug is suitable for use in an internal combustion engine in particular but may fundamentally also be used for other applications.

The glow plug includes at least one heating body, in particular a glow pencil. The heating body may be manufactured entirely or in part from a ceramic material, for example, silicon nitride ($Si_3N_4$). With respect to the possible design of the heating body, for example, reference may be made to the related art described above. However, other embodiments are also possible.

In addition, the glow plug includes at least one housing, for example, a housing which may be manufactured entirely or partially from a metallic material. The housing may partially or entirely surround the heating body and/or other components of the glow plug and may be embodied entirely or partially as a cylinder, for example.

The heating body has at least one first terminal contact extending from a base body of the heating body. For example, as described above, the base body may be designed as a glow pencil, for example, as a cylindrical glow pencil. The base body may have, for example, a tip pointing toward the combustion chamber and an opposite end. The first terminal contact on the opposite end may extend out of the base body and/or may extend away from the base body, for example, along or parallel to the axis of the base body. The terminal contact may extend, for example, through an opening in the housing into a housing interior. The terminal contact may be designed in the form of a metal cap, for example, having a top, which may be clamped and/or soldered onto a positive contact and/or some other electrical contact of the heating body. The first terminal contact itself may be designed to be entirely or partially stiff, i.e., such that it undergoes little or no deformation at least under the influence of its own weight. For example, the first terminal contact may be designed in the form of a stiff wire and/or in the form of a rod.

In addition, the glow plug has at least one second terminal contact extending at least partially inside the housing. This second terminal contact, which may be designed as a terminal pin, for example, extends within the housing to the end of the first terminal contact or up to just before this end.

In addition, at least one contact element in the glow plug within the housing is provided with at least one opening. A contact element is understood here to be an element which is preferably designed to be separate from the housing and is able to provide electrical contact between the first terminal contact and the second terminal contact. This electrical contact may be established by a direct connection between the first terminal contact and the second terminal contact, for example. As an alternative, the contact element may also be part of this electrical contact, so that electrical contact is established from the first terminal contact to the second terminal contact via the contacting element itself or vice versa. The first terminal contact and the second terminal contact are introduced into the opening in the contacting element from opposite sides and are connected to one another electrically.

BRIEF DESCRIPTION OF THE DRAWINGS

Exemplary embodiments of the present invention are depicted in the drawings and are explained in greater detail in the following description.

DETAILED DESCRIPTION OF THE INVENTION

Figure 1:
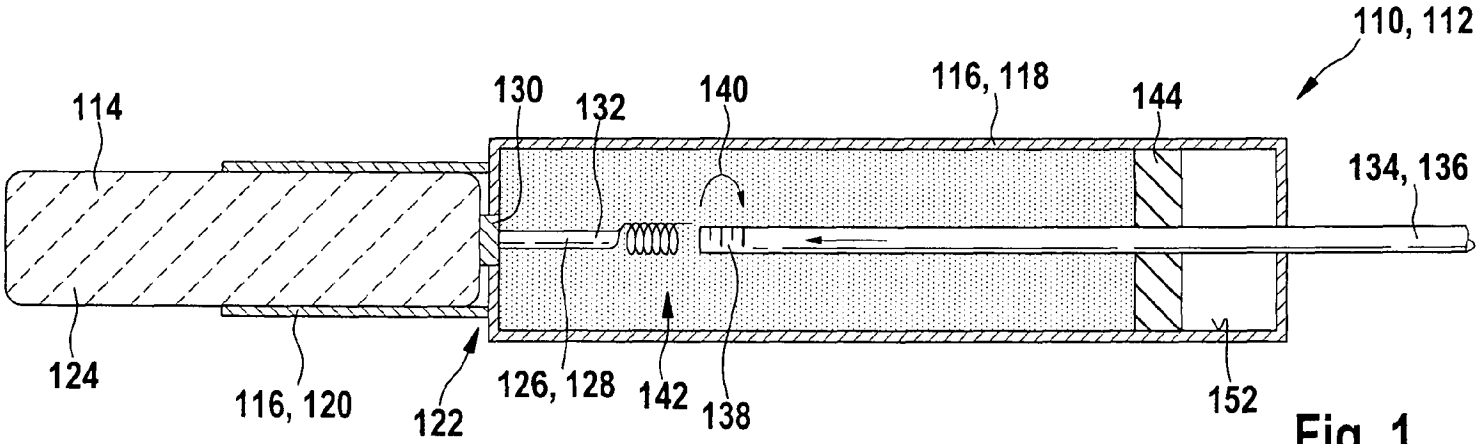
FIG. 1 shows an exemplary embodiment of a glow plug corresponding to the related art.

The contacting element may include at least one retaining element, in particular a disk, supported on an inside of the housing. For example, the retaining element may be adapted from its outer circumference to the internal cross section of the housing in at least one section of the housing so that the outside circumference of the contacting element may be directly or indirectly in contact with the inside of the housing in at least some sections. Alternatively, other elements may also be provided between the contacting element and the inside of the housing, for example, elements which secure the contacting element.

The contacting element may be designed in particular in such a way that the opening and/or an inside wall of the opening is/are electrically insulated with respect to the housing. Similarly, the contacting element may be manufactured entirely or partially from an insulating material.

When the contacting element is designed in the form of a disk, for example, in the form of a disk-shaped retaining element, in particular in the form of a circular disk, then this disk may have a round circumference, for example, preferably circular and/or polygonal, for example, square circumference. For example, the disk may have a metallic edge and/or an electrically conductive edge. For example, the edge may be manufactured from at least one metallic material. The disk may be designed to be electrically conductive in the area of the opening. The opening and the edge may be mutually electrically insulated. In general, however, it is pointed out that good electrical conductivity of the edge is not crucial because current is not usually conducted over the contacting element. Due to the metallic finish of the edge preferably proposed here, an airtight connection between the contacting element and the housing, for example, a supporting pipe, may be implemented as an airtight connection via laser welding, pressing or similar operations, for example.

In the area of the opening, the contacting element may also have at least one connecting element for form-fitting and/or force-fit connection of the contacting element with the first terminal contact and/or the second terminal contact. This connecting element, which establishes a mechanical connection, may have at least one thread, for example. However, other types of connections are also fundamentally possible, e.g., pinched connections, cutting-pinched connection or the like. In the case of the embodiment of the screw connection having at least one thread, it is preferable in particular if the first terminal contact and/or the second terminal contact also has/have a thread at its/their ends. Alternatively or additionally, the thread of the connecting element may also have a cutting function, which cuts a thread in the first terminal contact and/or the second terminal contact on being screwed into these elements.

As explained above, the heating body may include in particular at least one ceramic heating body, for example, a ceramic glow pencil and/or a ceramic heating body having a silicon nitride material. However, other embodiments are also fundamentally possible.

In addition, it is preferable if an interspace between the contacting element and the heating body is filled at least partially with a fluid medium, in particular with air. Here again, the proposed glow plug may also differ from the known glow plugs in which the housing is filled completely or partially with a ceramic powder at least in the area of the connection between the first terminal contact and the second terminal contact.

The housing may have a supporting tube in particular, the heating body being inserted at least partially into the supporting tube. Electrical contacting of the heating body may be accomplished via the supporting tube and via the first terminal contact. For example, the first terminal contact may be connected to a positive pole of the heating body, the supporting tube being able to establish a connection to a negative pole of the heating body on the circumference of the heating body.

The supporting tube may form only a portion of the housing or the housing may be embodied completely as a supporting tube. In the former case the supporting tube may be designed, for example, in such a way that the housing has a housing body on which the supporting tube is inserted via a shoulder. For example, the supporting tube may be embodied as a connection on the housing body, such that the shoulder having at least one opening to the feedthrough of the first terminal contact is provided in the area of the transition between the supporting tube and the housing body. A uniform inside diameter of the supporting tube may be chosen for the opening; in other words, the diameter of the opening may correspond essentially to the diameter of the heating body. In this case, the shoulder of the supporting tube may be provided only in the outside wall of the housing, for example. Alternatively, the housing may also have a housing body, the supporting tube being embodied in one piece with the housing body and preferably without a shoulder. This embodiment is possible because hammering to reinforce the support of the connection between the first and second terminal contacts, as provided according to the related art, is no longer necessary due to the use of the contacting element, so there is no longer any risk of damage to the heating body due to hammering. It is also possible to completely eliminate a supporting tube having a shoulder.

In addition to the glow plug proposed here, a method for manufacturing a glow plug is also proposed in one or more of the specific embodiments presented above. This method may be used in particular for manufacturing a glow plug in one or more of the specific embodiments described above, so that reference may be made to the above description for possible embodiments of the method. However, it is also fundamentally possible to manufacture other types of glow plugs. In this method at least one first terminal contact of the heating body extending from a base body of the heating body is inserted into a housing where it is introduced into an opening of the contacting element. At least one second terminal contact is introduced into the opening from an opposite side, and the first terminal contact and the second terminal contact are electrically connected to one another. Fundamentally any order may be used for introducing the first terminal contact and the second terminal contact into the opening. The connection may in turn be accomplished entirely or partially via the contacting element, so that it may also have an electrical function and/or may be directly involved in an electrical connection, in addition to the function of mechanical fixation of the ends of the first terminal contact and of the second terminal contact relative to one another.

The proposed glow plug and the proposed method have numerous advantages in comparison with the known glow plugs and manufacturing methods. In particular, a robust vibration-proof electrical and mechanical connection may be established between the first terminal contact and the second terminal contact. This virtually eliminates any risk to the heating body when establishing such a tight connection. Furthermore, the manufacturing method may be designed to be considerably simpler in comparison with known manufacturing methods involving filling operations and subsequent hammering operations, so that multiple method steps may be eliminated, and the housing may be accurately custom manufactured without any further machining. Ceramic-protecting constructions such as shoulders of the housing, in particular the supporting tube, may be omitted here, thus allowing on the whole a simpler and less expensive design of the housing.

FIG. 1 shows a known exemplary embodiment of a glow plug 110, which in this case is embodied as a sheathed-element glow plug 112. Glow plug 110 includes a ceramic heating body 114, which may be made entirely or partially of silicon nitride ceramic, for example.

In addition, glow plug 110 includes a housing 116 in the form of a cylindrical metallic housing, for example. Housing 116 in turn includes a housing body 118 and a supporting tube 120, which is attached to a shoulder 122 on housing body 118. Reference is made here to the fact that the shape of housing 116 shown in FIG. 1 as well as in FIG. 2, which is described in greater detail below, is intended only as an example. For example, an entire housing 116 may also be designed completely as supporting tube 120 in both figures. Furthermore, contrary to the diagram in the drawings, an inside diameter of housing 116 in the exemplary embodiments may also remain constant. Nevertheless, a shoulder 122 may be provided, for example, a shoulder 122 in which the inside diameter of housing 116 remains constant, but a wall thickness of supporting tube 120 increases after the shoulder.

Heating body 114 has a base body 124 having an $Si_3N_4$ ceramic. A negative pole of a heating element (not shown in FIG. 1) running inside heating body 114 may be contacted via supporting tube 120, for example. For contacting a positive pole of heating body 114, heating body 114 has a first terminal contact 126, which is designed as a so-called metal cap 128 in the case shown here and includes a top 130, which is soldered to a positive contact of heating body 114, and a wire 132, which is embodied in the form of a spiral.

A second terminal contact 134 in the form of a terminal pin 136, which is provided with a thread 138 on an end facing wire 132, is screwed into this wire 132 (indicated symbolically with reference numeral 140 in FIG. 1).

The interior of housing 116 is then partially filled with a ceramic powder filling 142. To prevent leakage of ceramic powder filling 142 and to support terminal pin 136, terminal pin 136 is supported in a sealing ring 144 on an end facing away from heating body 114. Terminal pin 136 protrudes out of housing 116, for example, on the end of housing 116 facing away from heating body 114, or it is terminated electrically in a manner not shown in greater detail here. For example, terminal pin 136 may end in a plug (not shown here), for example, a round plug, via additional connections in the interior of the housing. Powder filling 142 is used to secure the connection between wire 132 and terminal pin 136. This fixation is then reinforced by hammering of tubular housing body 118 or a part thereof, in particular supporting tube 120 having ceramic powder filling 142.

Known glow plug 110, which is shown in FIG. 1, is comparatively complex with regard to its manufacture. In particular, supporting tube 120, which is designed to be separate from base body 124 to prevent damage to the ceramic of heating body 114 due to the hammering operation, should be provided. For example, supporting tube 120 may be inserted into housing body 118 and/or other parts of housing 116. This ceramic-protecting tubular construction is complex. Furthermore, the method steps of loading ceramic powder filling 142 and then hammering same may themselves be complex and subject to error, and the connection established between first terminal contact 126 and second terminal contact 134 may be subject to error.

Figure 2:
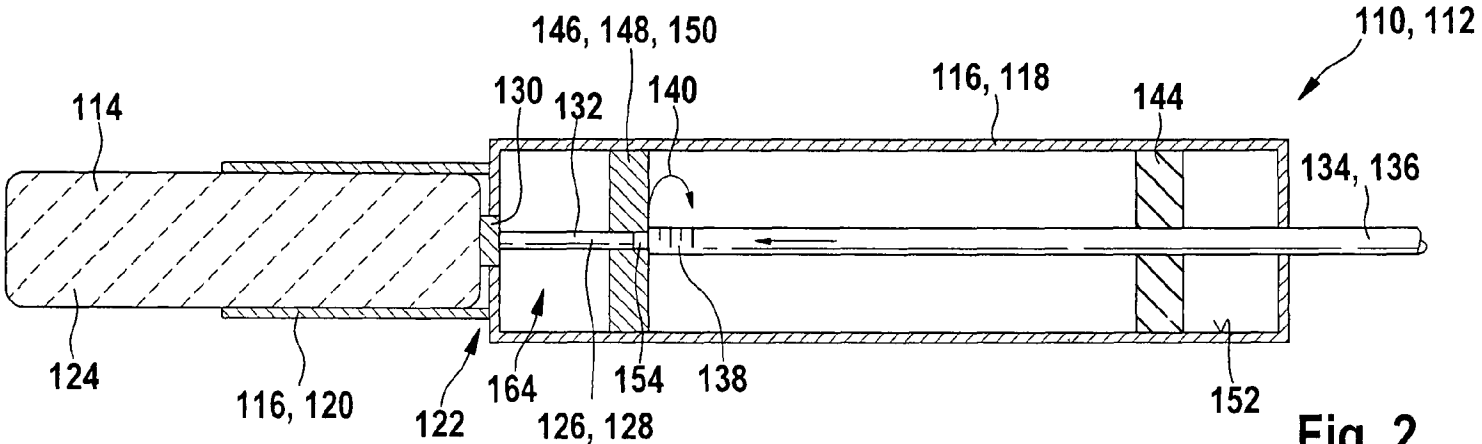
FIG. 2 shows a first exemplary embodiment of a modification according to the present invention of a glow plug according to FIG. 1.

FIG. 2 therefore shows a first exemplary embodiment of a glow plug 110 according to the present invention. This glow plug 110 has a design which initially largely corresponds to the design shown in FIG. 1, so reference may be made to the description of this figure to that extent.

However, glow plug 110 in the exemplary embodiment according to the present invention as shown in FIG. 2 has a contacting element 146, which is designed in the form of a disk 148 in this example. Disk 148 functions as a retaining element 150 and is designed as a circular disk, for example. On its circumference, disk 150 is supported on an inside 152 of housing 116.

Disk 148 has an opening 154. This opening need not necessarily be designed to be continuous but instead may also include blind bore holes from one side or both sides. First terminal contact 126 and second terminal contact 134 may be inserted into opening 154 from opposite sides.

Figure 4:
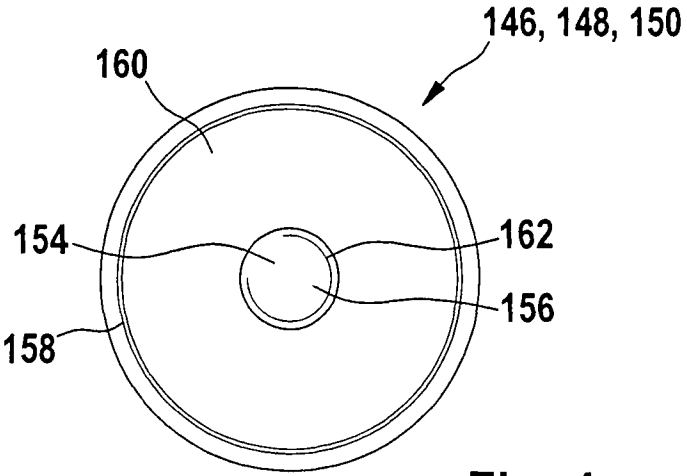
FIG. 4 shows an exemplary embodiment of a contacting element.

FIG. 4 shows an enlarged view of disk 148 as seen from above. It is discernible here that disk 148 has metal 156 in the area of its opening 154. In the exemplary embodiment shown here, disk 148 has a metal ring 158 on the circumference, for example. However, other embodiments are also possible. As explained above, an airtight connection between contacting element 146 and housing 116, for example, supporting tube 120, may be implemented by metal ring 158, for example, an airtight connection by laser welding, pressing or a similar operation. An insulator 160, for example, may be provided between metal 156 in opening 154 and metal ring 158.

Metal 156 may essentially be replaced by any stable material, but other materials may also be used as an alternative or in addition to a metal. The same thing is also true of metal ring 158, which may function as a frame. Essentially any insulating materials, for example, rubber, plastic, ceramic or the like, may be used as the insulator and thus as the disk material. As explained above, good electrical conductivity of contacting element 146 is not crucial in general because usually no electricity is conducted over contacting element 146.

Disk 148 having its opening 154 is used for supporting first terminal contact 126, which may in turn be designed as wire 132, for example. In order for good support to be implementable even with operation-related vibrations, the length of the wire between top 130 and disk 148 should be kept as short as possible. Alternatively or additionally, however, other supporting elements, for example, other disks 148 and/or contacting elements 146, may also be used.

In addition, a thread 162 and/or another type of mechanical connecting element may also be provided in and/or on opening 154. As also shown in FIG. 1, the end of second terminal contact 134 facing disk 148 may be designed to have a thread 138, which may be screwed into thread 162 of disk 148. This thread 162 may be a metal thread, for example. Wire 132 of heating body 114 leads into disk 148 on the side opposite thread 162. The position of base body 124 of heating body 114 within supporting tube 120 may be selected before securing this base body 124, e.g., before soldering it into position as required, e.g., according to a desired protruding length of heating body 114 in a combustion chamber of an internal combustion engine.

Ceramic powder filling 142 may be omitted in the exemplary embodiment according to FIG. 2. An interspace 164 between contacting element 146 and heating body 114 or shoulder 122 may be filled with air, for example.

Figure 3:
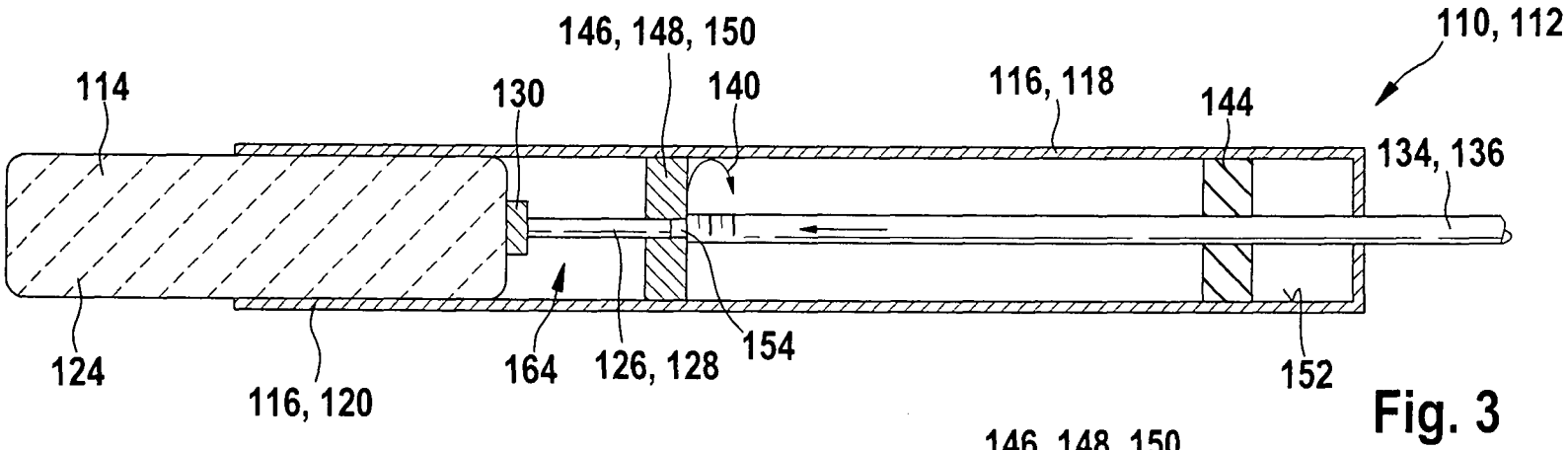
FIG. 3 shows a second exemplary embodiment of a glow plug according to the present invention.

FIG. 3 shows a second exemplary embodiment of a glow plug 110 according to the present invention. The design of this glow plug 110 essentially corresponds to the design according to FIG. 2, so that reference may again be made to the description of this figure. However, in this exemplary embodiment, housing 116 is designed in one piece and has no separation between a supporting tube 120 and a housing body 118 having a shoulder 122. As already explained above however, this two-part design of housing 116 in FIGS. 1 and 2 is also not obligatory, so that a constant inside diameter of housing 116 may also be provided in these figures, optionally combined with a step in the outside diameter of housing 116, e.g., via an increase in wall thickness.

Thus, in the exemplary embodiment according to FIG. 3, a housing 116, which is strictly in the shape of a cylindrical sleeve, is provided, the air-filled interspace 164 being formed directly between contacting element 146 and heating body 114. As described, this embodiment may also be provided in FIGS. 1 and 2. After installing heating body 114 in housing 116 and contacting first terminal contact 126 and second terminal contact 134, no hammering is necessary, so a housing 116, which is designed without a shoulder between housing body 118 and supporting tube 120, may be used. There is no risk of damage to heating body 114 due to a hammering operation.

A position of a ceramic, for example, an $Si_3N_4$ ceramic of base body 124 of heating body 114 in supporting tube 120, may also be selected in accordance with requirements, for example, a desired protruding length, before soldering. To allow a more flexible behavior in general, for example, to also allow bending of supporting tube 120 without damage to the ceramic of heating body 114, housing 116 or housing body 118 should start behind the ceramic of heating body 114, if possible.

What is claimed is:

1. A glow plug comprising:

at least one heating body and at least one housing, the heating body having at least one first terminal contact extending from a base body of the heating body into the housing, the glow plug also having a second terminal contact extending at least partially within the housing, wherein there is at least one contacting element inside the housing with at least one opening and wherein the first terminal contact and the second terminal contact are introduced into the opening from opposite sides and are electrically connected;

wherein the contacting element includes at least one retaining element supported on an inside of the housing; and wherein the retaining element is a disk.

2. The glow plug as recited in claim 1, wherein the contacting element opening is electrically insulated from the housing.

3. The glow plug as recited in claim 2, wherein the contacting element is in the form of a circular disk, the disk having an edge which is metallic or electrically conductive.

4. The glow plug as recited in claim 2, wherein the contacting element has at least one connecting element near the opening for form-fitting or force-fit connection to at least one of the first terminal contact and the second terminal contact.

5. The glow plug as recited in claim 1, wherein the contacting element is in the form of a circular disk, the disk having an edge which is metallic or electrically conductive.

6. The glow plug as recited in claim 5, wherein the contacting element has at least one connecting element near the opening for form-fitting or force-fit connection to at least one of the first terminal contact and the second terminal contact.

7. The glow plug as recited in claim 1, wherein the contacting element has at least one connecting element near the opening for form-fitting or force-fit connection to at least one of the first terminal contact and the second terminal contact.

8. The glow plug as recited in claim 7, wherein the connecting element has at least one thread.

9. The glow plug as recited in claim 1, wherein the heating body is a ceramic heating body or a ceramic heating body having a silicon nitride material.

10. The glow plug as recited in claim 9, wherein the heating body is a ceramic glow pencil.

11. The glow plug as recited in claim 1, wherein an intermediate space between the contacting element and the heating body is filled at least partially with air or another fluid medium.

12. The glow plug as recited in claim 1, wherein the housing has a supporting tube, the heating body being inserted at least partially into the supporting tube, and electrical contacting of the heating body is accomplished via the supporting tube and via the first terminal contact.

13. The glow plug as recited in claim 12, wherein the housing has a housing body, and the supporting tube is designed in one piece with the housing body and without a shoulder.

14. The glow plug as recited in claim 1, wherein the second terminal contact has a terminal pin, the terminal pin being pressed or screwed into the opening.

15. The glow plug as recited in claim 1, for use in an internal combustion engine.

* * * * *